US010000977B2

(12) United States Patent
Jain et al.

(10) Patent No.: US 10,000,977 B2
(45) Date of Patent: Jun. 19, 2018

(54) DRILL BIT WITH SELF-ADJUSTING PADS

(71) Applicant: Baker Hughes Incorporated, Houston, TX (US)

(72) Inventors: Jayesh R. Jain, The Woodlands, TX (US); Benjamin Baxter, Reno, NV (US); Chaitanya K. Vempati, Conroe, TX (US); Steven R. Radford, The Woodlands, TX (US); Volker Peters, Wienhausen (DE); Gregory L. Ricks, Spring, TX (US); Miguel Bilen, The Woodlands, TX (US); Holger Stibbe, Humble, TX (US); David A. Curry, Princes Risborough (GB)

(73) Assignee: Baker Hughes, a GE company, LLC, Houston, TX (US)

( * ) Notice: Subject to any disclaimer, the term of this patent is extended or adjusted under 35 U.S.C. 154(b) by 259 days.

(21) Appl. No.: 14/864,436

(22) Filed: Sep. 24, 2015

(65) Prior Publication Data

US 2016/0053551 A1 Feb. 25, 2016

Related U.S. Application Data

(63) Continuation of application No. 14/516,340, filed on Oct. 16, 2014, now Pat. No. 9,708,859, which is a (Continued)

(51) Int. Cl.
*E21B 10/60* (2006.01)
*E21B 10/50* (2006.01)
(Continued)

(52) U.S. Cl.
CPC ..... *E21B 10/62* (2013.01); *E21B 3/00* (2013.01); *E21B 10/42* (2013.01); *E21B 10/54* (2013.01); *E21B 2010/622* (2013.01)

(58) Field of Classification Search
CPC .... E21B 10/62; E21B 10/54; E21B 2010/622; E21B 7/064
See application file for complete search history.

(56) References Cited

U.S. PATENT DOCUMENTS 1,612,338 A * 12/1926 Wilson ..... E21B 4/16 173/15
3,050,122 A * 8/1962 Huitt ..... E21B 10/322 166/55.8
(Continued)

OTHER PUBLICATIONS

International Search Report for International Application No. PCT/2014/034493 dated Aug. 20, 2014, 4 pages.
(Continued)

*Primary Examiner* — Jennifer H Gay
(74) *Attorney, Agent, or Firm* — TraskBritt

(57) ABSTRACT

A drill bit includes a bit body; a pad associated with the bit body; and a rate control device coupled to the pad that extends from a bit surface at a first rate and retracts from an extended position to a retracted position at a second rate in response to external force applied onto the pad. The rate control device includes a piston for applying a force on the pad; a biasing member that applies a force on the piston to extend the pad at the first rate; a fluid chamber associated with the piston; and a pressure management device for controlling a fluid pressure within the fluid chamber.

26 Claims, 14 Drawing Sheets

Related U.S. Application Data continuation-in-part of application No. 13/864,926, filed on Apr. 17, 2013, now Pat. No. 9,255,450.

(51) Int. Cl.

| | |
|---|---|
| ***E21B 3/00*** | (2006.01) |
| ***E21B 10/40*** | (2006.01) |
| ***E21B 10/62*** | (2006.01) |
| ***E21B 10/54*** | (2006.01) |
| ***E21B 10/42*** | (2006.01) |

(56) References Cited

U.S. PATENT DOCUMENTS

| | | | | |
|---|---|---|---|---|
| 3,422,672 | A | 1/1969 | Payne | |
| 3,583,501 | A | 6/1971 | Aalund | |
| 4,386,669 | A | 6/1983 | Evans | |
| 4,856,601 | A | 8/1989 | Raney | |
| 5,553,678 | A | 9/1996 | Barr et al. | |
| 6,142,250 | A | 11/2000 | Griffin et al. | |
| 7,240,744 | B1 * | 7/2007 | Kemick | E21B 4/14 175/106 |
| 7,971,662 | B2 | 7/2011 | Beuershausen | |
| 8,061,455 | B2 | 11/2011 | Beuershausen | |
| 8,205,686 | B2 | 6/2012 | Beuershausen | |
| 8,763,726 | B2 | 7/2014 | Johnson et al. | |
| 9,708,859 | B2 * | 7/2017 | Jain | E21B 10/62 |
| 2007/0079991 | A1 * | 4/2007 | Cooley | B23B 27/12 175/57 |
| 2007/0221416 | A1 | 9/2007 | Hall et al. | |
| 2007/0272445 | A1 | 11/2007 | Cariveau et al. | |
| 2008/0000693 | A1 | 1/2008 | Hutton | |
| 2008/0017419 | A1 * | 1/2008 | Cooley | B23B 27/12 175/286 |
| 2009/0044979 | A1 | 2/2009 | Johnson et al. | |
| 2009/0107722 | A1 | 4/2009 | Chen et al. | |
| 2010/0025116 | A1 * | 2/2010 | Hutton | E21B 7/06 175/61 |
| 2010/0065334 | A1 | 3/2010 | Hall et al. | |
| 2010/0071956 | A1 | 3/2010 | Beuershausen | |
| 2010/0212964 | A1 | 8/2010 | Beuershausen | |
| 2011/0277990 | A1 | 11/2011 | Kotsonis et al. | |
| 2012/0255788 | A1 | 10/2012 | Schwefe et al. | |
| 2012/0318580 | A1 | 12/2012 | Oesterberg | |
| 2013/0025358 | A1 | 1/2013 | Radford et al. | |
| 2014/0027177 | A1 * | 1/2014 | Schwefe | E21B 10/62 175/40 |
| 2014/0311801 | A1 | 10/2014 | Jain et al. | |
| 2015/0191979 | A1 | 7/2015 | Jain et al. | |
| 2016/0032658 | A1 | 2/2016 | Jain | |

OTHER PUBLICATIONS

International Written Opinion for International Application No. PCT/2014/034493 dated Aug. 20, 2014, 10 pages.

Jain et al., Mitigation of Torsional Stick-Slip Vibrations in Oil Well Drilling through PDC Bit Design: Putting Theories to the Test, SPE 146561, SPE Annual Technical Conference and Exhibition, Dever, CO, Oct. 30, 2011-Nov. 2, 2011, 11 pages.

Canadian Office Action for Canadian Application No. 2909627 dated Aug. 12, 2016, three pages.

The Extended European Search Report for European Patent No. 2986804 dated Nov. 25, 2016, four pages.

Supplementary European Search Report for European Application No. 14785132, dated Nov. 15, 2016, two pages.

* cited by examiner

DRILL BIT WITH SELF-ADJUSTING PADS

CROSS-REFERENCE TO RELATED APPLICATIONS

This application is a continuation of U.S. patent application Ser. No. 14/516,340, filed Oct. 16, 2014, now U.S. Pat. No. 9,708,859, issued Jul. 18, 2017, which is a continuation-in-part of U.S. Non-Provisional patent application Ser. No. 13/864,926, filed Apr. 17, 2013, now U.S. Pat. No. 9,255,450, issued Feb. 9, 2016, each of which is incorporated herein by reference in its entirety.

TECHNICAL FIELD

This disclosure relates generally to drill bits and systems that utilize same for drilling wellbores.

BACKGROUND

Oil wells (also referred to as "wellbores" or "boreholes") are drilled with a drill string that includes a tubular member having a drilling assembly (also referred to as the "bottom-hole assembly" or "BHA"). The BHA typically includes devices and sensors that provide information relating to a variety of parameters relating to drilling operations ("drilling parameters"), behavior of the BHA ("BHA parameters") and parameters relating to the formation surrounding the wellbore ("formation parameters"). A drill bit attached to the bottom end of the BHA is rotated by rotating the drill string and/or by a drilling motor (also referred to as a "mud motor") in the BHA to disintegrate the rock formation to drill the wellbore. A large number of wellbores are drilled along contoured trajectories. For example, a single wellbore may include one or more vertical sections, deviated sections and horizontal sections through differing types of rock formations. When drilling progresses from a soft formation, such as sand, to a hard formation, such as shale, or vice versa, the rate of penetration (ROP) of the drill changes and can cause (decreases or increases) excessive fluctuations or vibration (lateral or torsional) in the drill bit. The ROP is typically controlled by controlling the weight-on-bit (WOB) and rotational speed (revolutions per minute or "RPM") of the drill bit so as to control drill bit fluctuations. The WOB is controlled by controlling the hook load at the surface and the RPM is controlled by controlling the drill string rotation at the surface and/or by controlling the drilling motor speed in the BHA. Controlling the drill bit fluctuations and ROP by such methods requires the drilling system or operator to take actions at the surface. The impact of such surface actions on the drill bit fluctuations is not substantially immediate. Drill bit aggressiveness contributes to the vibration, whirl and stick-slip for a given WOB and drill bit rotational speed. "Depth of Cut" (DOC) of a drill bit, generally defined as "the distance the drill bit advances along axially into the formation in one revolution," is a contributing factor relating to the drill bit aggressiveness. Controlling DOC can provide a smoother borehole, avoid premature damage to the cutters and prolong operating life of the drill bit.

The disclosure herein provides a drill bit and drilling systems using the same configured to control the rate of change of instantaneous DOC of a drill bit during drilling of a wellbore.

BRIEF SUMMARY

In one aspect, a drill bit is disclosed, including: a bit body; a pad associated with the bit body; a rate control device coupled to the pad that extends from a bit surface at a first rate and retracts from an extended position to a retracted position at a second rate in response to external force applied onto the pad, the rate control device including: a piston for applying a force on the pad; a biasing member that applies a force on the piston to extend the pad at the first rate; a fluid chamber associated with the piston; and a pressure management device for controlling a fluid pressure within the fluid chamber.

In another aspect, a method of drilling a wellbore is disclosed, including: providing a drill bit including a bit body, a pad associated with the bit body, and a rate control device; conveying a drill string into a formation, the drill string having a drill bit at the end thereof; selectively extending the pad from a bit surface at a first rate via the rate control device; selectively retracting from an extended position to a retracted position at a second rate in response to external force applied onto the pad via the rate control device, the rate control device including: a piston for applying a force on the pad; a biasing member that applies a force on the piston to extend the pad at the first rate; a fluid chamber associated with the piston; and controlling a fluid pressure within the fluid chamber via a pressure management device; and drilling the wellbore using the drill string.

In another aspect, a system for drilling a wellbore is disclosed, including: a drilling assembly having a drill bit, the drill bit including: a bit body; a pad associated with the bit body; a rate control device coupled to the pad that extends from a bit surface at a first rate and retracts from an extended position to a retracted position at a second rate in response to external force applied onto the pad, the rate control device including: a piston for applying a force on the pad; a biasing member that applies a force on the piston to extend the pad at the first rate; a fluid chamber associated with the piston; and a pressure management device for controlling a fluid pressure within the fluid chamber.

In another aspect, a drill bit is disclosed, including: a bit body; a pad associated with the bit body; a rate control device coupled to the pad that extends from a bit surface at a first rate and retracts from an extended position to a retracted position at a second rate in response to an external force applied, the rate control device including: a piston for applying a force on the pad; a biasing member that applies a force on the piston to expose the pad at the first rate; and a rotary device that applies a force on the piston to hide the pad at the second rate.

Examples of certain features of the apparatus and method disclosed herein are summarized rather broadly in order that the detailed description thereof that follows may be better understood. There are, of course, additional features of the apparatus and method disclosed hereinafter that will form the subject of the claims appended hereto.

BRIEF DESCRIPTION OF THE DRAWINGS

The disclosure herein is best understood with reference to the accompanying figures, wherein like numerals have generally been assigned to like elements and in which.

DETAILED DESCRIPTION

Figure 1:
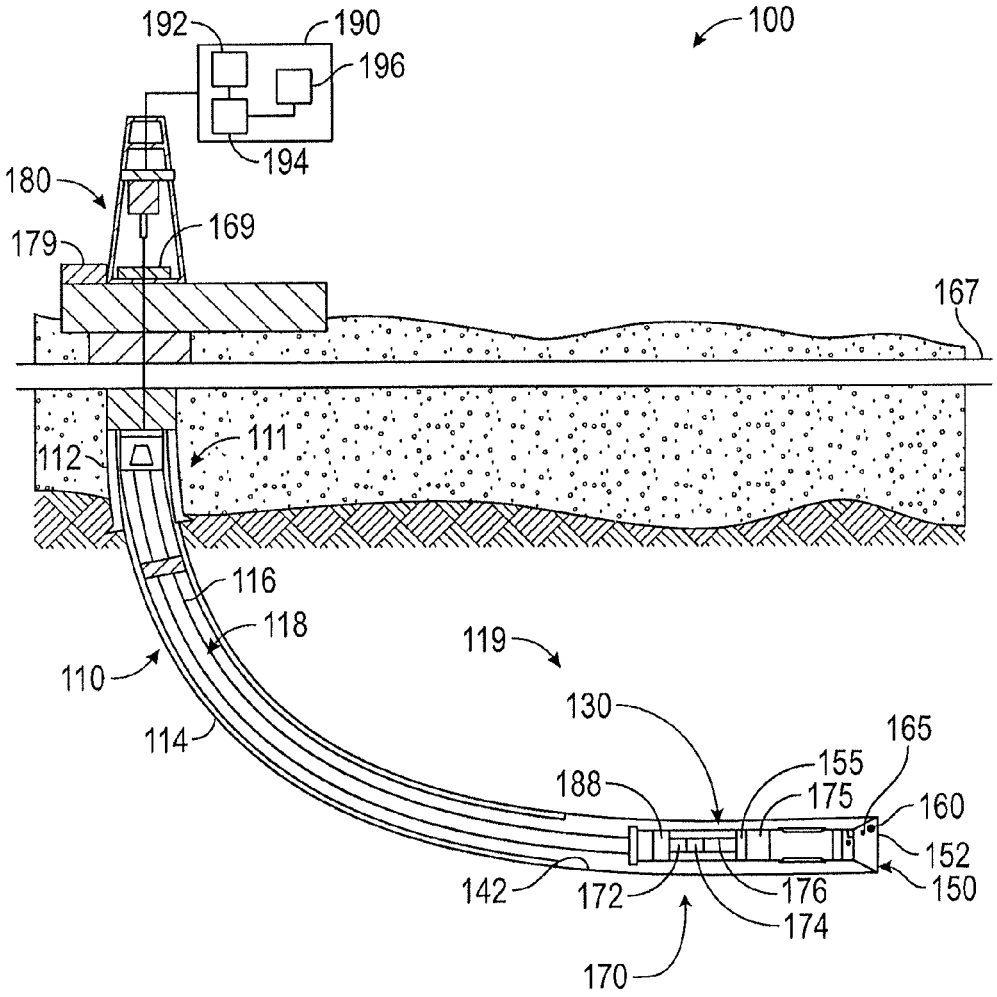
FIG. 1 is a schematic diagram of an exemplary drilling system that includes a drill string that has a drill bit made according to one embodiment of the disclosure.

FIG. 1 is a schematic diagram of an exemplary drilling system 100 that may utilize drill bits made according to the disclosure herein. FIG. 1 shows a wellbore 110 having an upper section 111 with a casing 112 installed therein and a lower section 114 being drilled with a drill string 118. The drill string 118 is shown to include a tubular member 116 with a BHA 130 attached at its bottom end. The tubular member 116 may be made up by joining drill pipe sections or it may be a coiled-tubing. A drill bit 150 is shown attached to the bottom end of the BHA 130 for disintegrating the rock formation 119 to drill the wellbore 110 of a selected diameter.

Drill string 118 is shown conveyed into the wellbore 110 from a rig 180 at surface 167. The exemplary rig 180 shown is a land rig for ease of explanation. The apparatus and methods disclosed herein may also be utilized with an offshore rig used for drilling wellbores under water. A rotary table 169 or a top drive (not shown) coupled to the drill string 118 may be utilized to rotate the drill string 118 to rotate the BHA 130 and thus the drill bit 150 to drill the wellbore 110. A drilling motor 155 (also referred to as the "mud motor") may be provided in the BHA 130 to rotate the drill bit 150. The drilling motor 155 may be used alone to rotate the drill bit 150 or to superimpose the rotation of the drill bit 150 by the drill string 118. A control unit (or surface controller) 190, which may be a computer-based unit, may be placed at the surface 167 to receive and process data transmitted by the sensors in the drill bit 150 and the sensors in the BHA 130, and to control selected operations of the various devices and sensors in the BHA 130. The surface controller 190, in one embodiment, may include a processor 192, a data storage device (or a computer-readable medium) 194 for storing data, algorithms and computer programs 196. The data storage device 194 may be any suitable device, including, but not limited to, a read-only memory (ROM), a random-access memory (RAM), a flash memory, a magnetic tape, a hard disk and an optical disk. During drilling, drilling fluid 179 from a source thereof is pumped under pressure into the tubular member 116. The drilling fluid 179 discharges at the bottom of the drill bit 150 and returns to the surface via the annular space (also referred as the "annulus") between the drill string 118 and the inside wall 142 of the wellbore 110.

The BHA 130 may further include one or more downhole sensors (collectively designated by numeral 175). The sensors 175 may include any number and type of sensors, including, but not limited to, sensors generally known as measurement-while-drilling (MWD) sensors or logging-while-drilling (LWD) sensors, and sensors that provide information relating to the behavior of the BHA 130, such as drill bit rotation (revolutions per minute or "RPM"), tool face, pressure, vibration, whirl, bending, and stick-slip. The BHA 130 may further include a control unit (or controller) 170 that controls the operation of one or more devices and sensors in the BHA 130. The controller 170 may include, among other things, circuits to process the signals from sensor 175, a processor 172 (such as a microprocessor) to process the digitized signals, a data storage device 174 (such as a solid-state memory), and a computer program 176. The processor 172 may process the digitized signals, and control downhole devices and sensors, and communicate data information with the controller 190 via a two-way telemetry unit 188.

Still referring to FIG. 1, the drill bit 150 includes a face section (or bottom section) 152. The face section 152 or a portion thereof faces the formation in front of the drill bit 150 or the wellbore bottom during drilling. The drill bit 150, in one aspect, includes one or more pads 160 that may be extended and retracted from a selected surface of the drill bit 150. The pads 160 are also referred to herein as the "extensible pads," "extendable pads," or "adjustable pads." A suitable actuation device (or actuation unit) 165 in the drill bit 150 may be utilized to extend and retract one or more pads from a drill bit surface during drilling of the wellbore 110. In one aspect, the actuation device 165 may control the rate of extension and retraction of the pad 160. The actuation device 165 is also referred to as a "rate control device" or "rate controller." In another aspect, the actuation device 165 is a passive device that automatically adjusts or self-adjusts the extension and retraction of the pad 160 based on or in response to the force or pressure applied to the pad 160 during drilling. In certain embodiments, the actuation device 165 and pad 160 are actuated by contact with the formation. Further, a substantial force on pads 160 is experienced when the depth of cut of drill bit 150 is changed rapidly. Accordingly, it is desirable for the actuation device 165 to resist changes to the depth of cut. In certain embodiments, actuation device 165 will increase the weight on bit at a given depth of cut. In other embodiments, actuation device 165 will reduce the depth of cut for a given weight on bit. The rate of extension and retraction of the pad 160 may be preset as described in more detail in reference to FIGS. 2-4.

Figure 2:
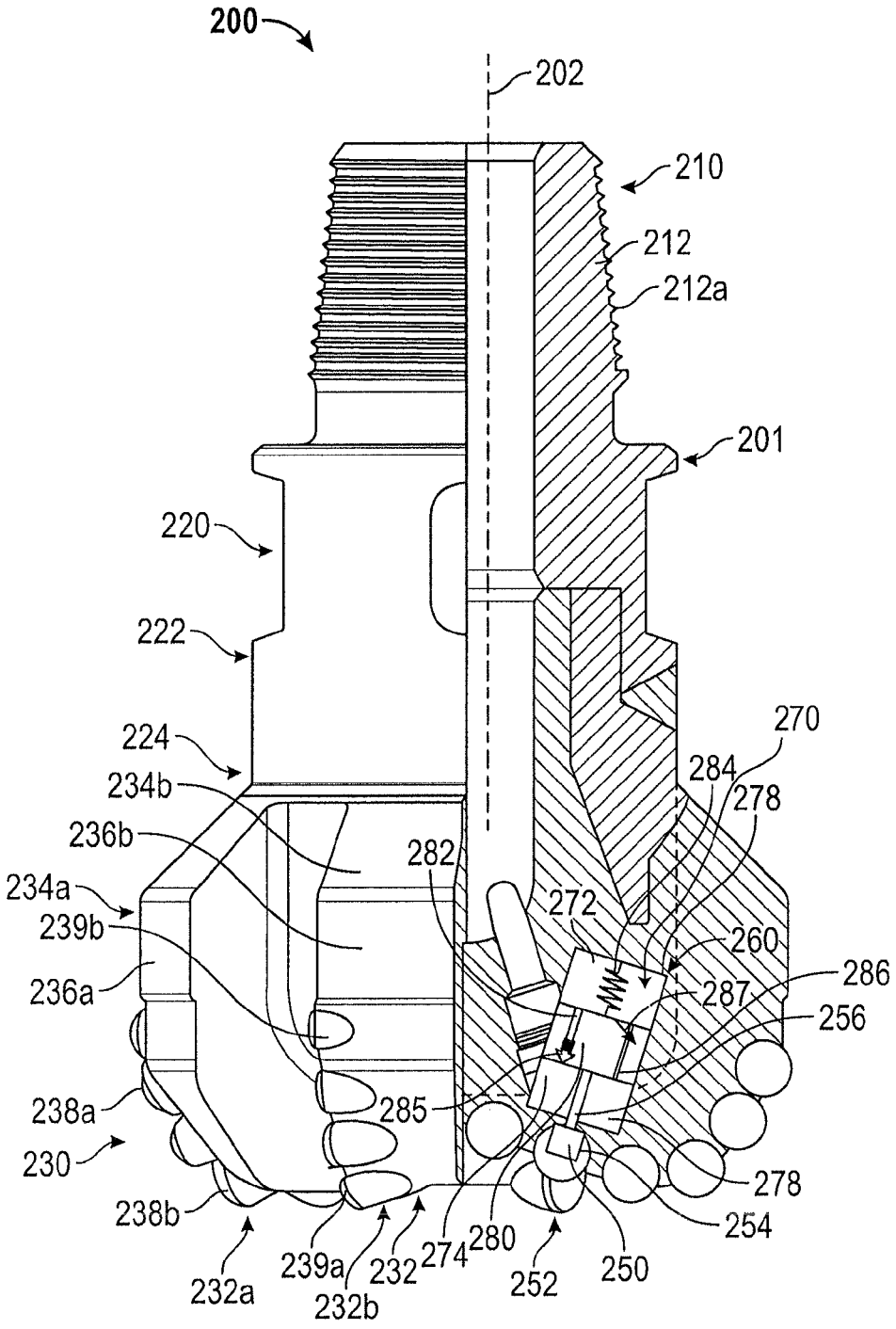
FIG. 2 shows a partial cross-sectional view of an exemplary drill bit with a pad and a rate control device for controlling the rates of extending and retracting the pad from a drill bit surface, according to one embodiment of the disclosure.

FIG. 2 shows an exemplary drill bit 200 made according to one embodiment of the disclosure. In an exemplary embodiment, the drill bit 200 is a polycrystalline diamond compact (PDC) bit having a bit body 201 that includes a neck or neck section 210, a shank 220 and a crown or crown section 230. In other embodiments, the drill bit 200 is any suitable drill bit or formation removal device for use in a formation. In other embodiments, drill bit 200 is any suitable downhole rotary tool. The neck 210 has a tapered upper end 212 having threads 212*a* thereon for connecting the drill bit 200 to a box end of the BHA 130 (FIG. 1). The shank 220 has a lower vertical or straight section 222 that is fixedly connected to the crown 230 at a joint 224. The crown 230 includes a face or face section 232 that faces the formation during drilling. The crown 230 includes a number of blades, such as blades 234*a*, 234*b*, etc. A typical PDC bit includes 3-7 blades. Each blade has a face (also referred to as a "face section") and a side (also referred to as a "side section"). For example, blade 234*a* has a face 232*a* and a side 236*a*, while blade 234*b* has a face 232*b* and a side 236*b*. The sides 236*a* and 236*b* extend along a longitudinal or vertical axis 202 of the drill bit 200. Each blade further includes a number of cutters. In the particular embodiment of FIG. 2, blade 234*a* is shown to include cutters 238*a* on a portion of the side 236*a* and cutters 238*b* along the face 232*a* while blade 234*b* is shown to include cutters 239*a* on the side 236*b* and cutters 239*b* on the face 232*b*.

Still referring to FIG. 2, the drill bit 200 includes one or more elements or members (also referred to herein as pads) that extend and retract from a surface 252 of the drill bit 200. FIG. 2 shows a pad 250 movably placed in a cavity or recess 254 in the crown section 230. An activation device 260 may be coupled to the pad 250 to extend and retract the pad 250 from a drill bit surface 252 location. In one aspect, the activation device 260 controls the rate of extension and retraction of the pad 250. In another aspect, the device 260 extends the pad at a first rate and retracts the pad 250 at a second rate. In embodiments, the first rate and second rate may be the same or different rates. In another aspect, the rate of extension of the pad 250 may be greater than the rate of retraction. As noted above, the device 260 also is referred to herein as a "rate control device" or a "rate controller." In the particular embodiment of the device 260, the pad 250 is directly coupled to the device 260 via a mechanical connection or connecting member 256. In one aspect, the device 260 includes a chamber 270 that houses a double-acting reciprocating member, such as a piston 280, that sealingly divides the chamber 270 into a first chamber 272 and a second chamber or reservoir 274. Both chambers 272 and 274 are filled with a hydraulic fluid 278 suitable for downhole use, such as oil. A biasing member 284, such as a spring, in the first chamber 272, applies a selected force on the piston 280 to cause it to move outward. Since the piston 280 is connected to the pad 250, moving the piston outward causes the pad 250 to extend from the surface 252 of the drill bit 200. In one aspect, the chambers 272 and 274 are in fluid communication with each other via a first fluid flow path or flow line 282 and a second fluid flow path or flow line 286. A flow control device 285, such as a check valve, placed in the fluid flow line 282, may be utilized to control the rate of flow of the fluid 278 from chamber 274 to chamber 272. Similarly, another flow control device, such as a check valve 287, placed in fluid flow line 286, may be utilized to control the rate of flow of the fluid 278 from chamber 272 to chamber 274. The flow control devices 285 and 287 may be configured at the surface to set the rates of flow through fluid flow lines 282 and 286, respectively. In another aspect, the rates may be set or dynamically adjusted by an active device, such as by controlling fluid flows between the chambers by actively controlled valves. In certain embodiments, the fluid flow is controlled actively by adjusting fluid properties by using electro or magneto rheological fluids and controllers. In other embodiments, piezo electronics are utilized to control fluid flows. In one aspect, one or both flow control devices 285 and 287 may include a variable control biasing device, such as a spring, to provide a constant flow rate from one chamber to another. Constant fluid flow rate exchange between the chambers 272 and 274 provides a first constant rate for the extension for the piston 280 and a second constant rate for the retraction of the piston 280 and, thus, corresponding constant rates for extension and retraction of the pad 250. The size of the flow control lines 282 and 286 along with the setting of their corresponding flow control devices 285 and 287 define the flow rates through lines 282 and 286, respectively, and thus the corresponding rate of extension and retraction of the pad 250. In one aspect, the fluid flow line 282 and its corresponding flow control device 285 may be set such that when the drill bit 200 is not in use, i.e., there is no external force being applied onto the pad 250, the biasing member 284 will extend the pad 250 to the maximum extended position. In one aspect, the flow control line 282 may be configured so that the biasing member 284 extends the pad 250 relatively fast or suddenly. When the drill bit 200 is in operation, such as during drilling of a wellbore, the weight on bit applied to the bit exerts an external force on the pad 250. This external force causes the pad 250 to apply a force or pressure on the piston 280 and thus on the biasing member 284.

In one aspect, the fluid flow line 286 may be configured to allow relatively slow flow rate of the fluid 278 from the first chamber 272 into the second chamber or reservoir 274, thereby causing the pad 250 to retract relatively slowly. As an example, the extension rate of the pad 250 may be set so that the pad 250 extends from the fully retracted position to a fully extended position over a few seconds while it retracts from the fully extended position to the fully retracted position over one minute, several minutes, or longer (such as between 2-5 minutes). It will be noted, that any suitable rate may be set for the extension and retraction of the pad 250. In one aspect, the activation device 260 is a passive device that adjusts the extension and retraction of a pad based on or in response to the force or pressure applied on the pad 250. In an exemplary embodiment, the pads 250 are wear-resistant elements, such as cutters, ovoids, elements making rolling contact, or other elements that reduce friction with earth formations. In certain embodiments, pads 250 are directly in front and in the same cutting groove as the cutters 239*a*, 238*b*. In an exemplary embodiment, device 260 is oriented with a tilt against the direction of rotation to minimize the tangential component of friction force experienced by the piston 280. In certain embodiments, the device 260 is located inside the blades 234*a*, 234*b*, etc., supported by the bit body 201 with a press fit near the face 232*a* of the bit 200 and a threaded cap or retainer or a snap ring near the top end of the side portion 236*a*, 236*b*.

Figure 3:
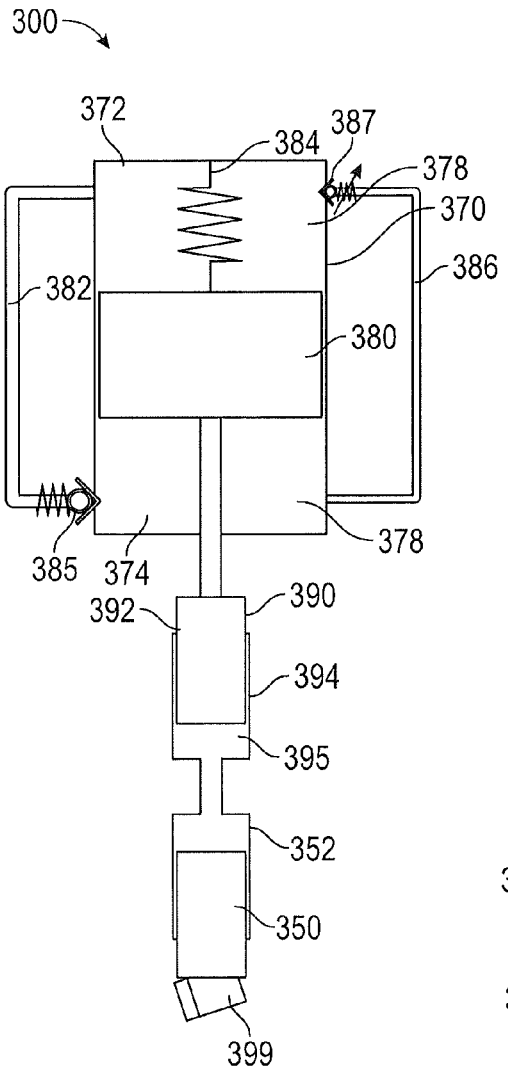
FIG. 3 shows an alternative embodiment of the rate control device that operates the pad via a hydraulic line.

FIG. 3 shows an alternative rate control device 300. The device 300 includes a fluid chamber 370 divided by a double-acting piston 380 into a first chamber 372 and a second chamber or reservoir 374. The chambers 372 and 374 are filled with a hydraulic fluid 378. A first fluid flow line 382 and an associated flow control device 385 allow the fluid 378 to flow from chamber 374 to chamber 372 at a first flow rate and a fluid flow line 386 and an associated flow control device 387 allow the fluid 378 to flow from the chamber 372 to chamber 374 at a second rate. The piston 380 is connected to a force transfer device 390 that includes a piston 392 in a chamber 394. The chamber 394 contains a hydraulic fluid 395, which is in fluid communication with a pad 350. In one aspect, the pad 350 may be placed in a chamber 352, which chamber is in fluid communication with the fluid 395 in chamber 394. When a biasing device 384 moves the piston 380 outward, it moves the piston 392 outward and into the chamber 394. Piston 392 expels fluid 395 from chamber 394 into the chamber 352, which extends the pad 350. When a force is applied onto the pad 350, it pushes the fluid in chamber 352 into chamber 394, which applies a force onto the piston 380. The rate of the movement of the piston 380 is controlled by the flow of the fluid through the fluid flow line 386 and flow control device 387. In the particular configuration shown in FIG. 3, the rate control device 300 is not directly connected to the pad 350, which enables isolation of the device 300 from the pad 350 and allows it to be located at any desired location in the drill bit, as described in reference to FIGS. 5 and 6. In another aspect, the pad 350 may be directly connected to a cutter 399 or an end of the pad 350 may be made as a cutter. In this configuration, the cutter 399 acts both as a cutter and an extendable and retractable pad.

Figure 4:
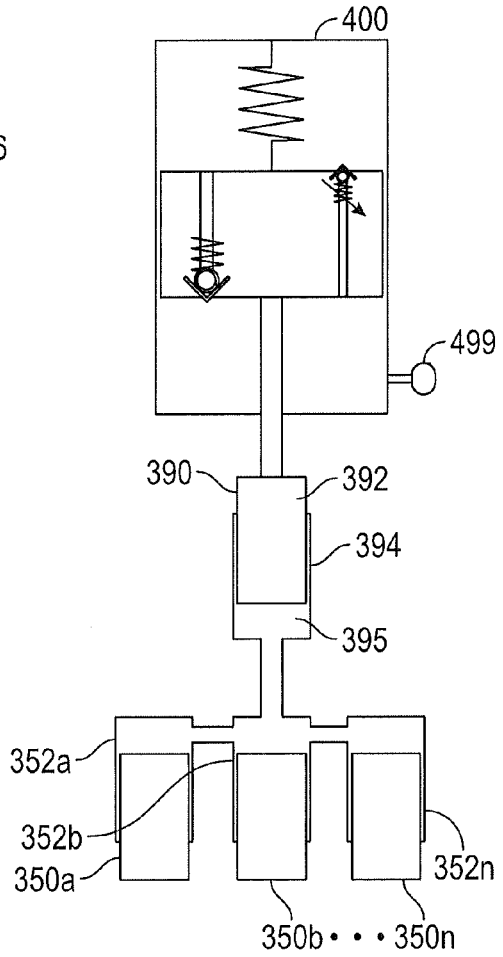
FIG. 4 shows an embodiment of a rate control device configured to operate multiple pads.

FIG. 4 shows a common rate control device 400 configured to operate more than one pad, such as pads 350*a*, 350*b* . . . 350*n*. The rate control device 400 is the same as shown and described in FIG. 2, except that it is shown to apply force onto the pads 350*a*, 350*b* . . . 350*n* via the force transfer device 390, as shown and described in reference to FIG. 3. In the embodiment of FIG. 4, each of the pads 350*a*, 350*b* . . . 350*n* is housed in separate chambers 352*a*, 352*b* . . . 352*n*, respectively. The fluid 395 from chamber 394 is supplied to all chambers, thereby automatically and simultaneously extending and retracting each of the pads 350*a*, 350*b* . . . 350*n* based on external forces applied to each such pads during drilling. In some aspects, the rate control device 400 may include a suitable pressure compensator 499 for downhole use. Similarly, any of the rate controllers made according to any of the embodiments may employ a suitable pressure compensator.

Figure 5:
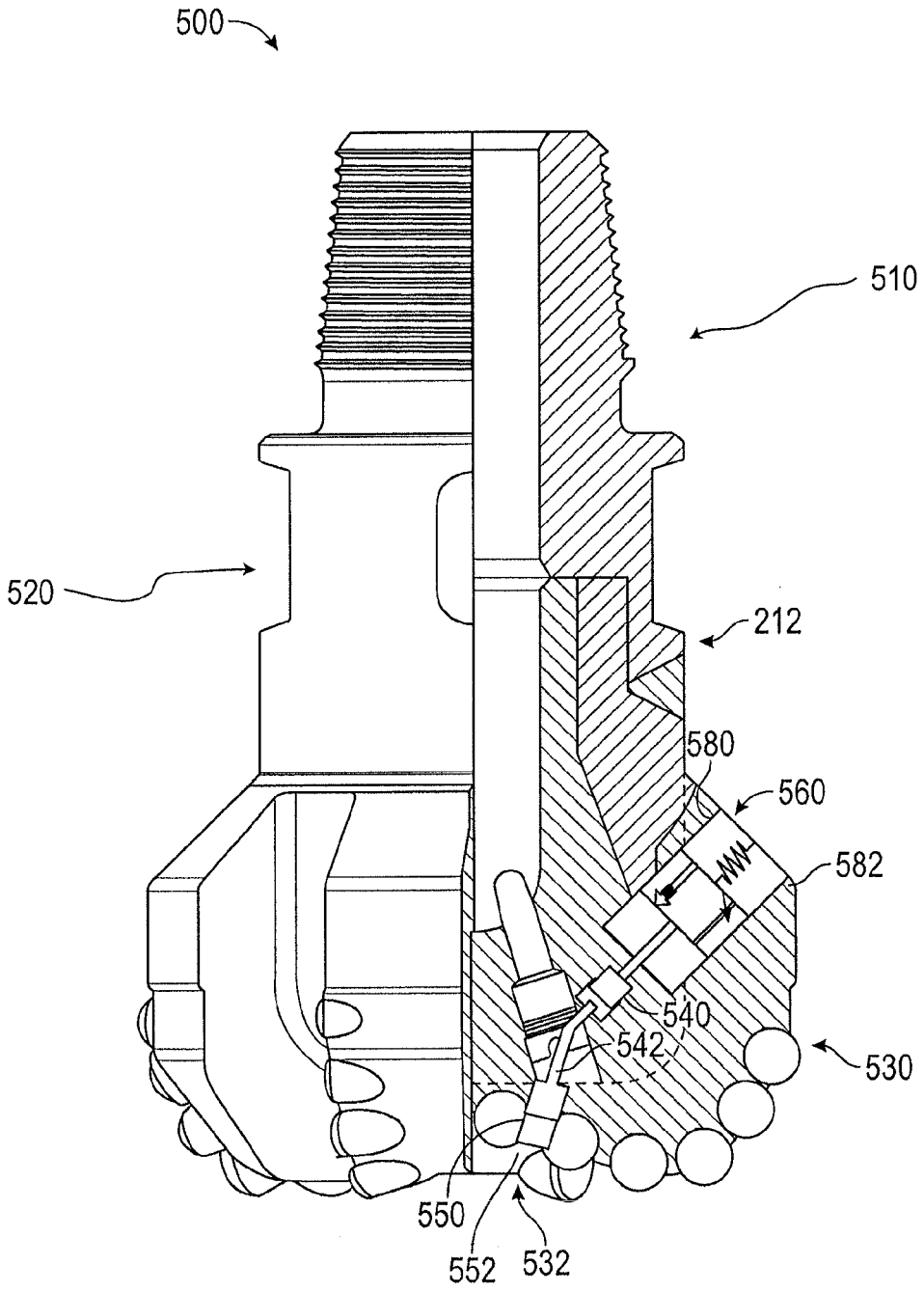
FIG. 5 shows placement of a rate control device of FIG. 3 in the crown section of the drill bit.

FIG. 5 shows an isometric view of a drill bit 500, wherein a rate control device 560 is placed in a crown section 530 of the drill bit 500. The rate control device 560 is the same as shown in FIG. 2, but is coupled to a pad 550 via a hydraulic connection 540 and a fluid line 542. The rate control device 560 is shown placed in a recess 580 accessible from an outside surface 582 of the crown section 530. The pad 550 is shown placed at a face location section 552 on drill bit face 532, while the hydraulic connection 540 is shown placed in the crown 530 between the pad 550 and the rate control device 560. It should be noted that the rate control device 560 may be placed at any desired location in the drill bit 500, including in the shank and neck section and the fluid line 542 may be routed in any desired manner from the rate control device 560 to the pad 550. Such a configuration provides flexibility of placing the rate control device 560 substantially anywhere in the drill bit 500.

Figure 6:
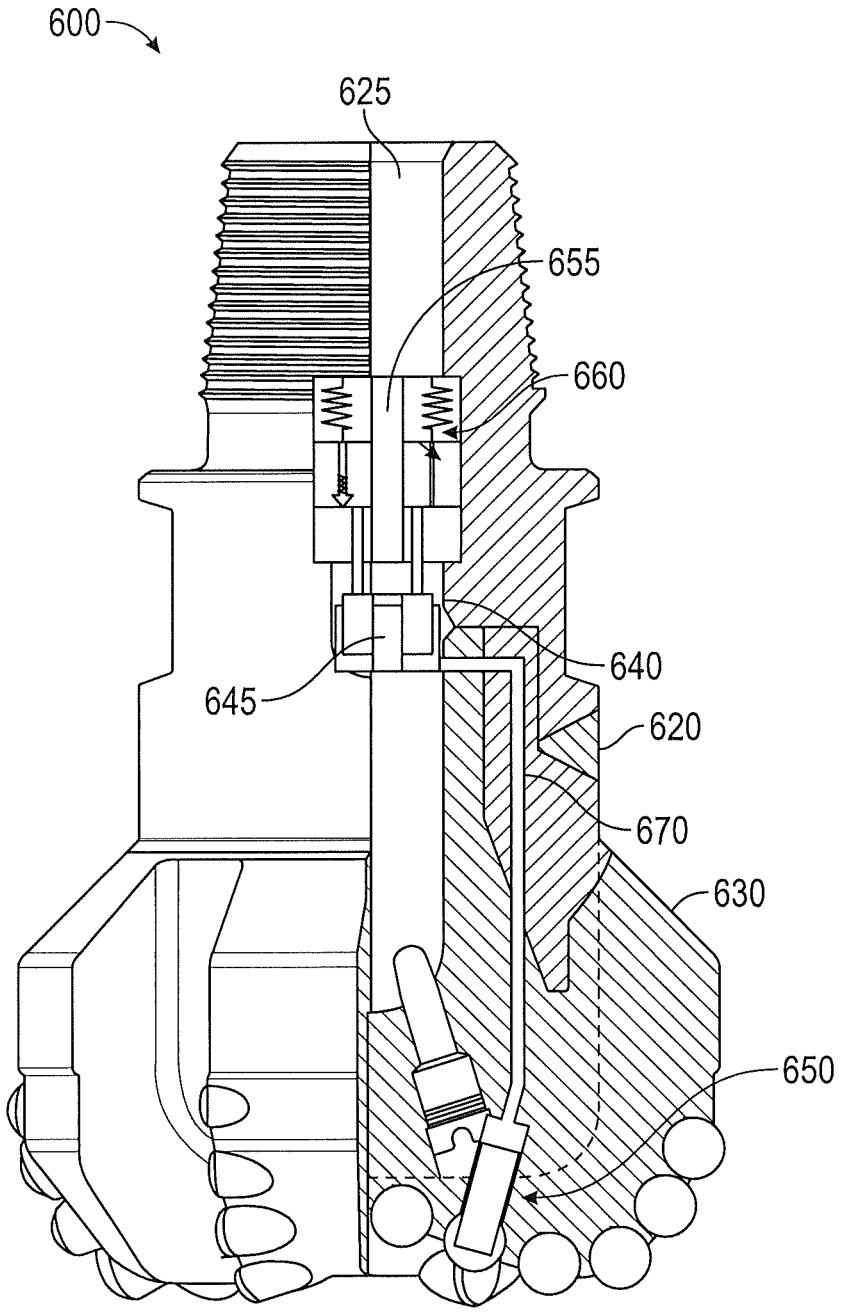
FIG. 6 shows placement of a rate control device of in the the fluid passage or flow path of the drill bit.

FIG. 6 shows an isometric view of a drill bit 600, wherein a rate control device 660 is placed in a fluid passage 625 of the drill bit 600. In the particular drill bit configuration of FIG. 6, a hydraulic connection 640 is placed proximate the rate control device 660. A hydraulic line 670 is run from the hydraulic connection 640 to pad 650 through shank 620 and crown 630 of the drill bit 600. During drilling, a drilling fluid flows through the passage 625. To enable the drilling fluid to flow freely through the passage 625, the rate control device 660 may be provided with a through bore or passage 655 and the hydraulic connection 640 may be provided with a flow passage 645.

Figure 7:
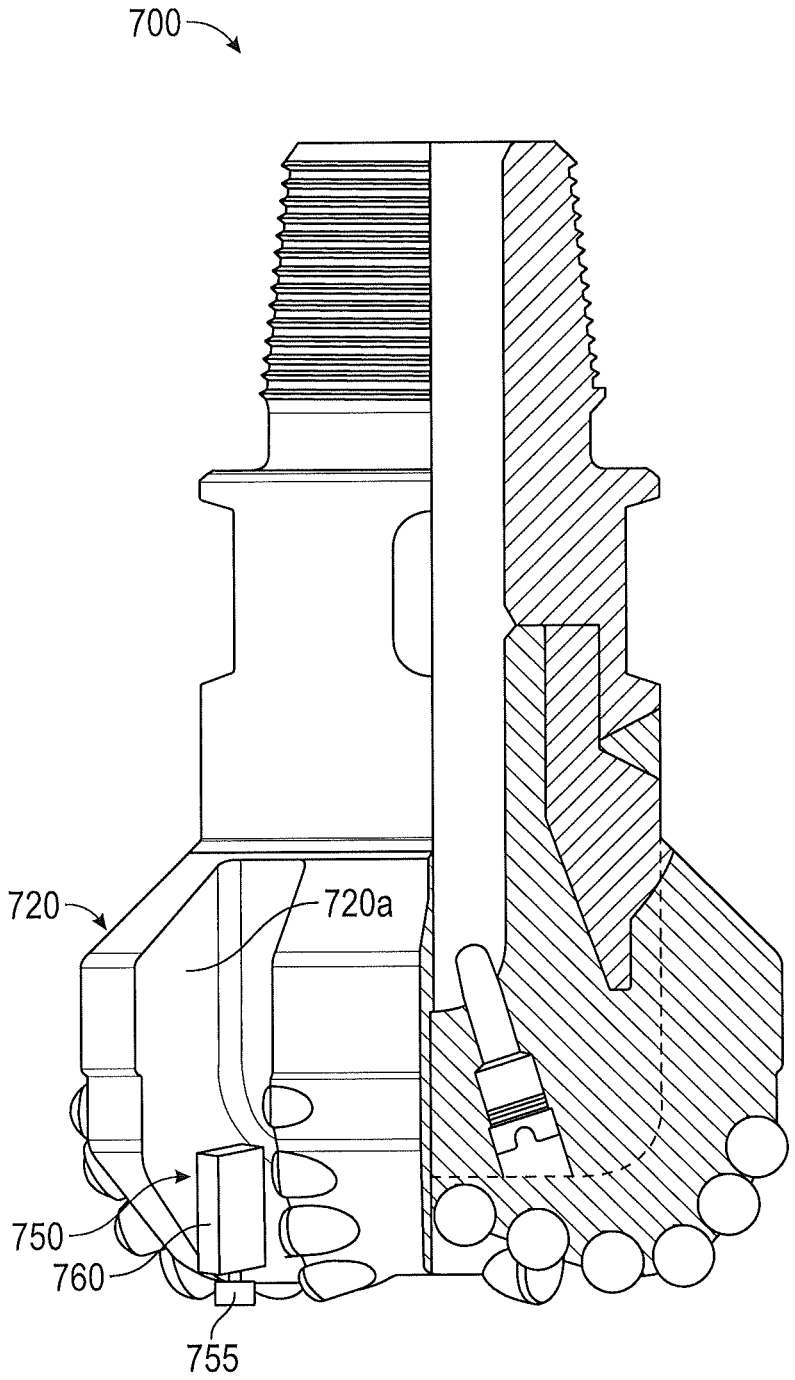
FIG. 7 shows a drill bit, wherein the rate control device and the pad are placed on an outside surface of the drill bit.

FIG. 7 shows a drill bit 700, wherein an integrated pad and rate control device 750 is placed on an outside surface of the drill bit 700. In one aspect, the device 750 includes a rate control device 760 connected to a pad 755. In one aspect, the device 750 is a sealed unit that may be attached to any outside surface of the drill bit 700. The rate control device 760 may be the same as or different from the rate control devices described herein in reference to FIGS. 2-6. In the particular embodiment of FIG. 7, the pad 755 is shown connected to a side 720*a* of a blade 720 of the drill bit 700. The device 750 may be attached or placed at any other suitable location in the drill bit 700. Alternatively or in addition thereto, the device 750 may be integrated into a blade so that the pad 755 will extend toward a desired direction from the drill bit 700.

Figure 8A:
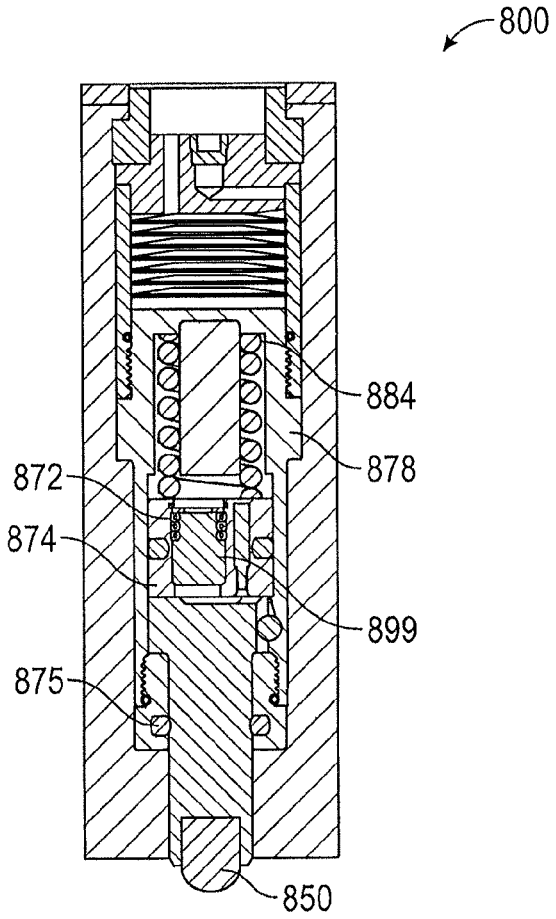
FIG. 8A shows an embodiment of a rate control device with a multistage orifice.
Figure 8B:
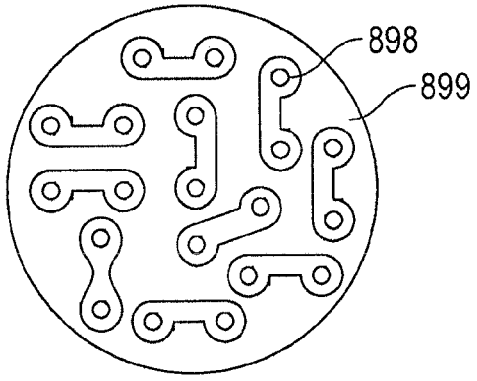
FIG. 8B shows an embodiment of a multistage orifice for use with the rate control device illustrated in FIG. 8A.

FIG. 8A shows an integrated rate control device 800. In an exemplary embodiment rate control devices 800 are individual self-contained cartridges to be disposed inside the blades of a bit, such as the bits previously described. In this embodiment, rate control functionality is achieved through a pressure management device, such as multi-stage orifice 899. FIG. 8B shows the multi-stage orifice 899 with a plurality of orifices 898 that provide a tortuous path for fluid 878 between upper chamber 872 and lower chamber 874. In an exemplary embodiment, upper chamber 872 is subject to a higher pressure than lower chamber 874. In certain embodiments, lower chamber 874 is close to downhole pressure. Accordingly, in an exemplary embodiment, multistage orifice 899 controls the movement and pressure within the integrated rate control device 800 in conjunction with biasing member 884, by controlling the flow of fluid 878 therein. Accordingly, the rate of pad 850 is effectively controlled by adjusting the properties of the multi-stage orifice 899. In certain embodiments, the lower chamber 874 is pressure-compensated. In an exemplary embodiment, the lower chamber 874 is pressure compensated with downhole pressure to minimize the pressure differential across the mud-oil seal 875 at the bit face.

Figure 9:
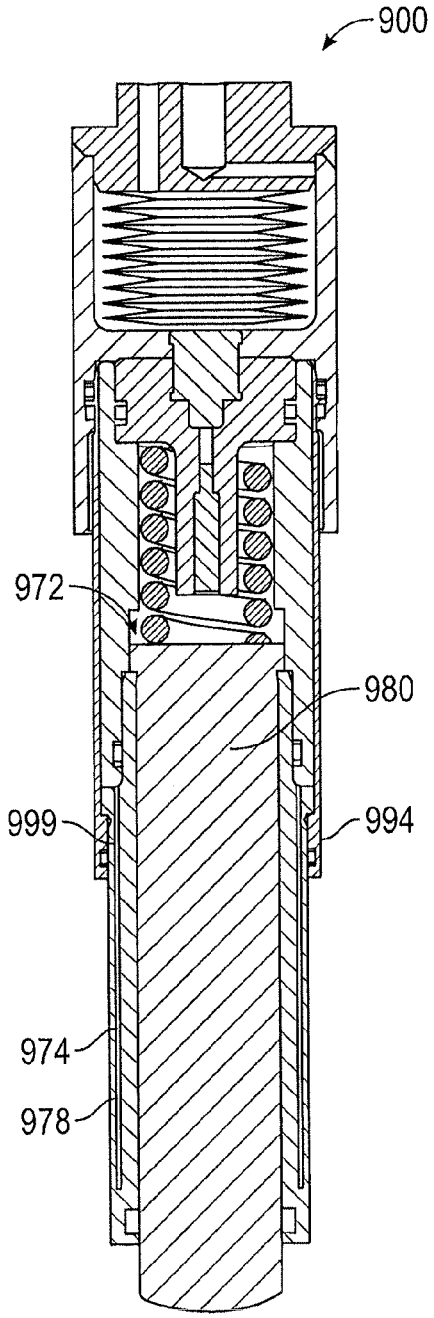
FIG. 9 shows an embodiment of a rate control device with a high-precision gap.

FIG. 9 shows an integrated rate control device 900. In an exemplary embodiment, rate control devices 900 are self-contained cartridges disposed inside the blades of a bit, such as the bits previously described. In this embodiment, the rate control functionality is achieved through a pressure management device, such as high-precision gap 999 between piston 980 and cylinder 994. The high-precision gap 999 allows a predetermined amount of fluid 978 to be transferred between upper chamber 972 and lower chamber 974 at a given pressure differential, effectively controlling the rate of movement of piston 980. In certain embodiments, high-precision gap 999 also acts as a high-pressure seal between the two chambers 972, 974. In certain embodiments, the chambers 972, 974, respectively, contain a high-pressure fluid and a low-pressure fluid. In an exemplary embodiment, the lower chamber 974 (low-pressure chamber) is pressure-compensated with downhole pressure to minimize the pressure differential across the mud-oil seal (not shown) at the bit face. In an exemplary embodiment, the pressure-compensation is achieved through bellows in communication with the downhole formation pressure.

Figure 10:
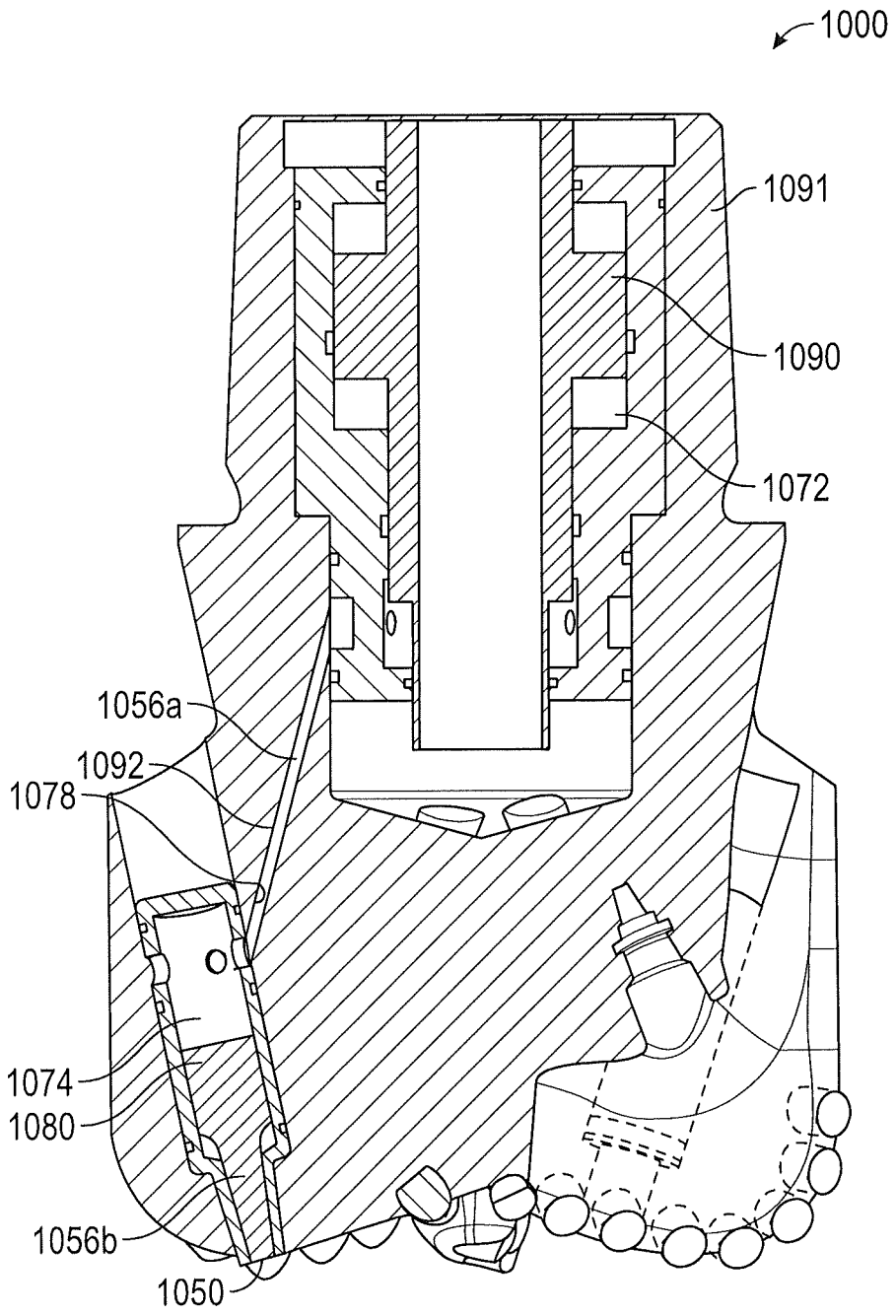
FIG. 10 shows an embodiment of a rate control device configured to operate multiple pads.

FIG. 10 shows a drill bit 1000 with a rate control device 1090 located in a bit shank 1091 of the drill bit 1000. In an exemplary embodiment, rate control device 1090 is hydraulically connected to multiple pistons 1080 via hydraulic passages 1092 that allow passage of fluid 1078 therethrough to act as a linkage 1056*a*. Advantageously, the central location of rate control device 1090 allows for a large space for the rate control device 1090 while allowing multiple pistons 1080 to be utilized and share load during drill bit operations. In certain embodiments, the pressure drop across the drill bit 1000 is utilized to create a downward force. In these embodiments, a low-pressure chamber 1074 is compensated to have the same pressure as the drilling fluid pressure inside the drill bit 1000, while a top rod or chamber 1072 of the compensated piston 1080 is exposed to the pressure inside the drill bit 1000 causing a net downward force. In certain embodiments, a secondary linkage 1056*b* is hydraulically or mechanically linked to a pad 1050.

Figure 11:
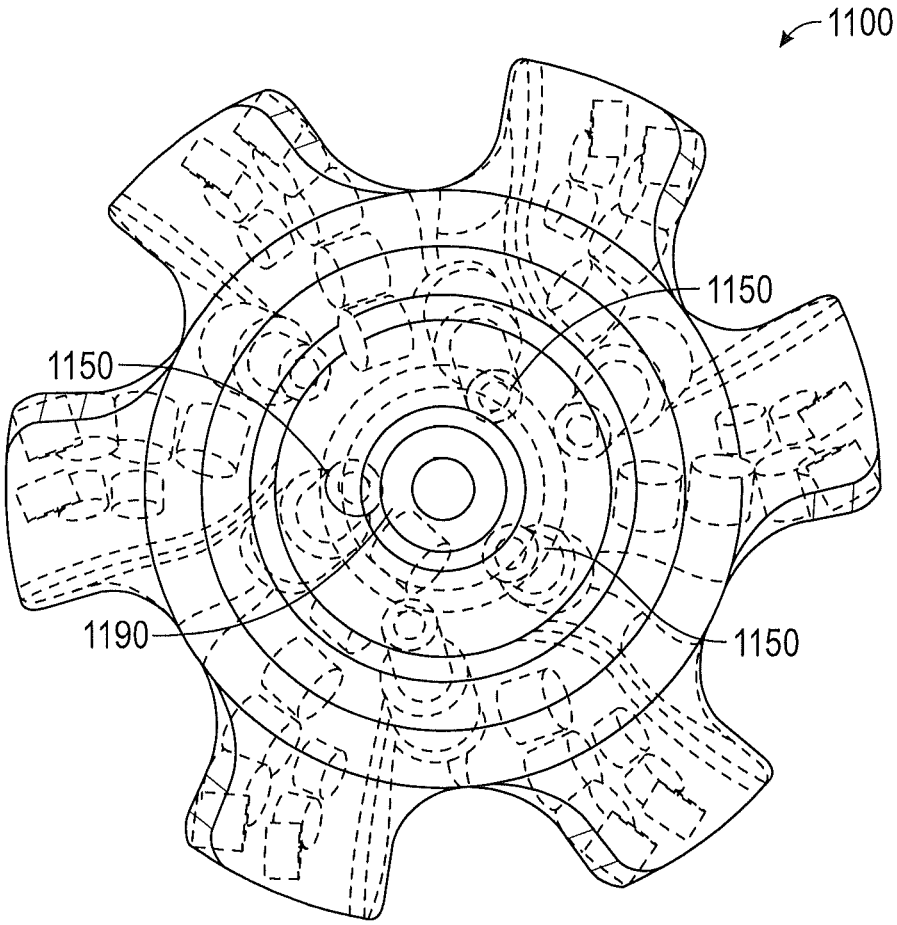
FIG. 11 shows an embodiment of a rate control device configured to operate extending from the center of the bit.

FIG. 11 shows a drill bit 1100 with a rate controller 1190 centrally located in the drill bit 1100. In an exemplary embodiment, the rate control device 1190 is centrally located and mechanically or hydraulically connected to multiple pads 1150. Advantageously, this allows for reduction in the peak pressure inside the rate controller 1190 and also reduces the number of parts as the pads 1150 are centrally actuated as shown in FIG. 4.

Figure 12:
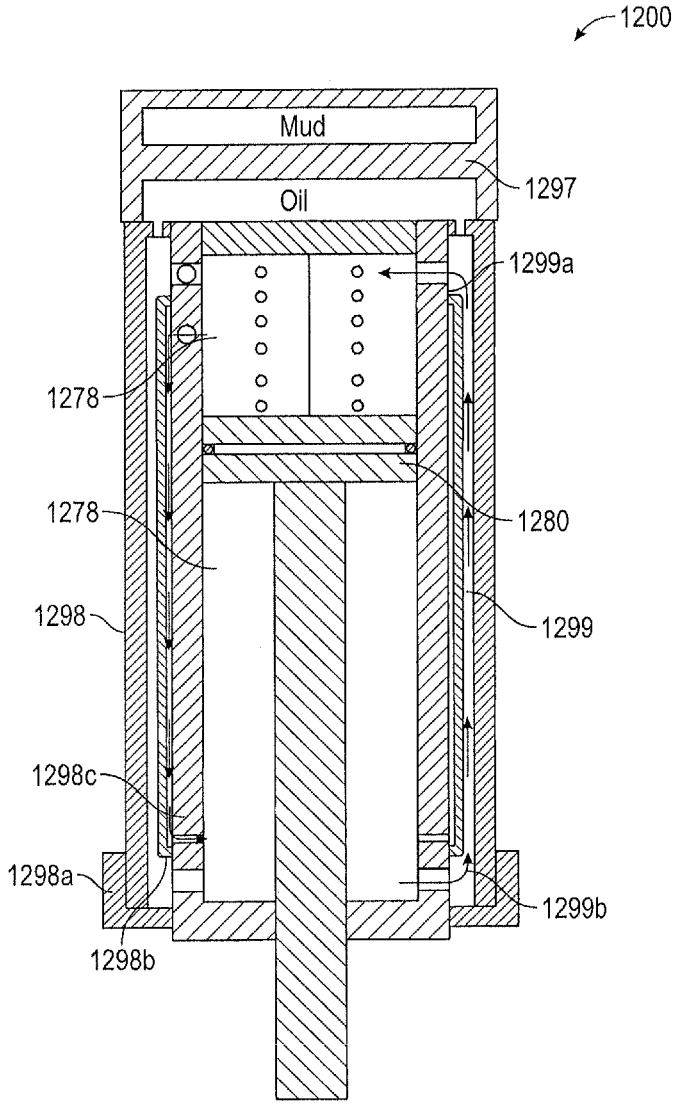
FIG. 12 shows an embodiment of a rate control device with a multi-wall chamber.

FIG. 12 shows a rate control device 1200 that utilizes a triple-walled cylinder 1298 with annular gaps 1299 between walls 1298*a*, 1298*b*, 1298*c*. In an exemplary embodiment, annular gap 1299 is a pressure management device, such as a high-precision gap to restrict flow of fluid 1278 to control the movement of piston 1280. In an exemplary embodiment, flow of fluid 1278 moves through ports 1299*a* and 1299*b* to interface with both sides of piston 1280. In certain embodiments, ports 1299*a* and 1299*b* have check valves to restrict the flow of fluid 1278. During operation, fluid 1278 is restricted by gap 1299 to control the flow of fluid 1278, resulting in the controlled movement of piston 1280. In certain embodiments, a pressure compensator 1297 is utilized to compensate the pressure of lower chamber 1274 to downhole fluid pressure.

Figure 13:
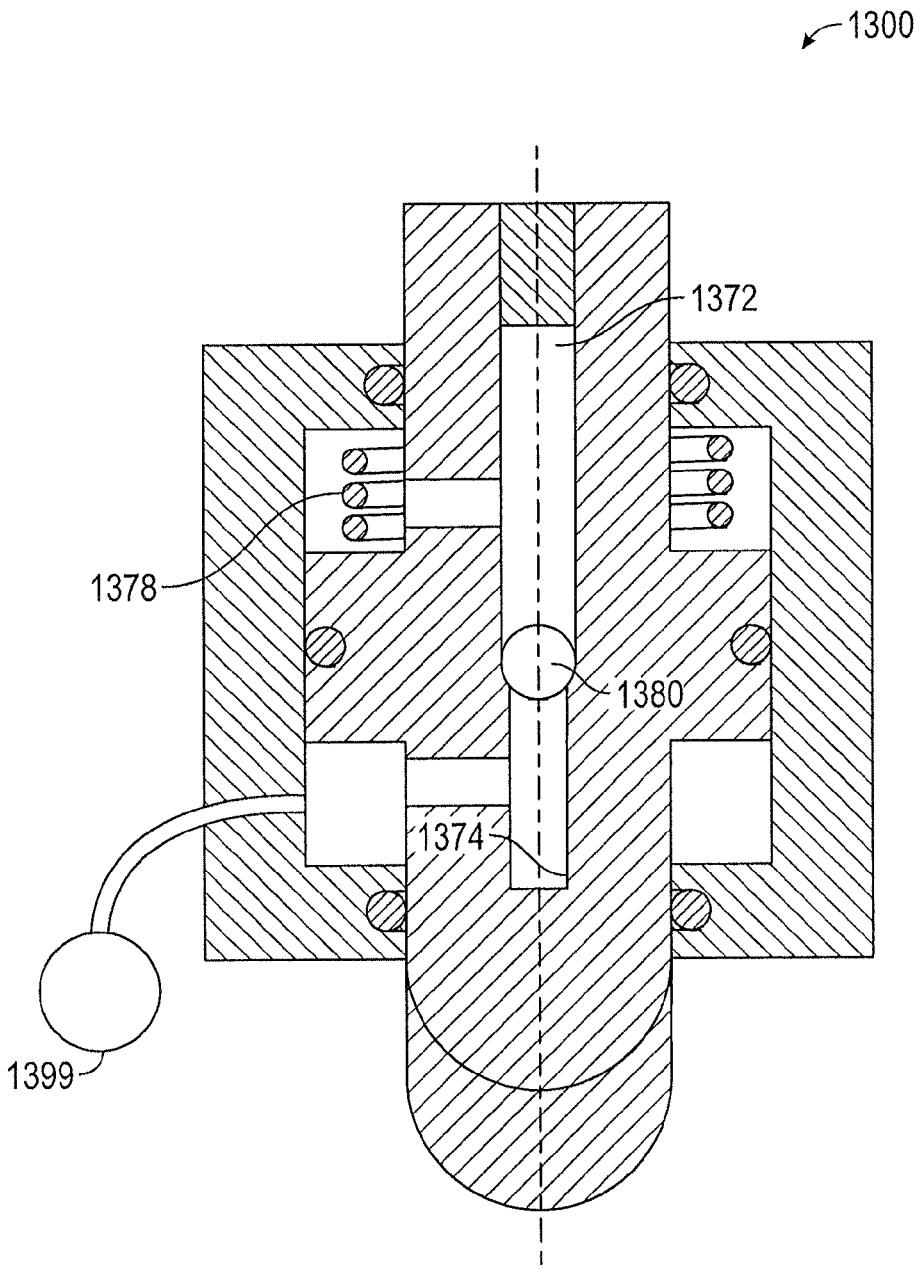
FIG. 13 shows an embodiment of a rate control device with a compensated piston.

FIG. 13 shows a rate control device 1300 with a double-acting or compensated piston 1380. In an exemplary embodiment, a double-acting piston 1380 with substantially equal rod size is exposed to both upper chamber 1372 and lower chamber 1374. In an exemplary embodiment, both ends of piston 1380 are exposed to the bottomhole pressure so that net force on the piston 1380 due to drilling fluid pressure is near zero. In certain embodiments, a hydraulic accumulator 1399 can be used with the compensated piston 1380 to accommodate for fluid volume changes with temperature, trapped air, and leakages. In certain embodiments, a biasing member 1378 is utilized to provide a downward force. Advantageously, both chambers 1372, 1374 are compensated to minimize the pressure differential between the rate control device 1300 and the wellbore.

Figure 14:
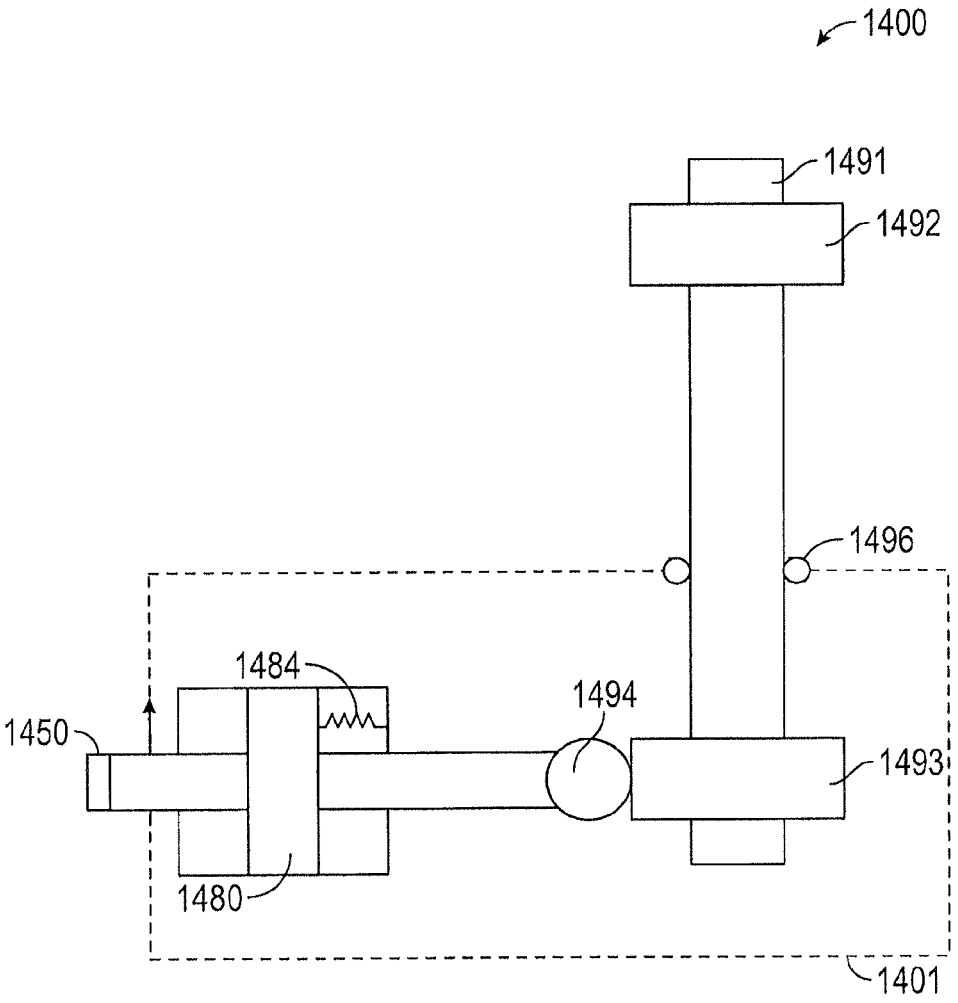
FIG. 14 shows an embodiment of a rate control device with a rotary device.

FIG. 14 shows a rate control device 1400 that utilizes a rotary seal 1496 at the mud-oil interface when disposed within a drill bit (shown schematically as 1401). In an exemplary embodiment, a cam 1492 is located outside of the drill bit 1401 and the rotary motion is transmitted via shaft 1491 into the bit body through a rotary seal 1496. The rotary motion is converted into a translational motion inside the bit body using a second cam 1493 and a follower 1494 attached to a piston 1480. In certain embodiments, such as when a low depth of cut is desired, the first cam 1492 exposes an adaptive element 1450 attached. As an external load is experienced by first cam 1492, the load rotates the first cam 1492, and in turn the second cam 1493, which in turn causes inward motion (hiding) of the piston 1480. When the external load is released, the piston 1480 extends due to a spring 1484 force, and in turn rotates the cams 1492, 1493 and exposes the adaptive elements 1450. Thus, the adaptive element 1450 is extended (exposed) and retracted (hidden) at different rates controlled by cams 1492, 1493 profile and biasing member 1484 characteristics.

Figure 15:
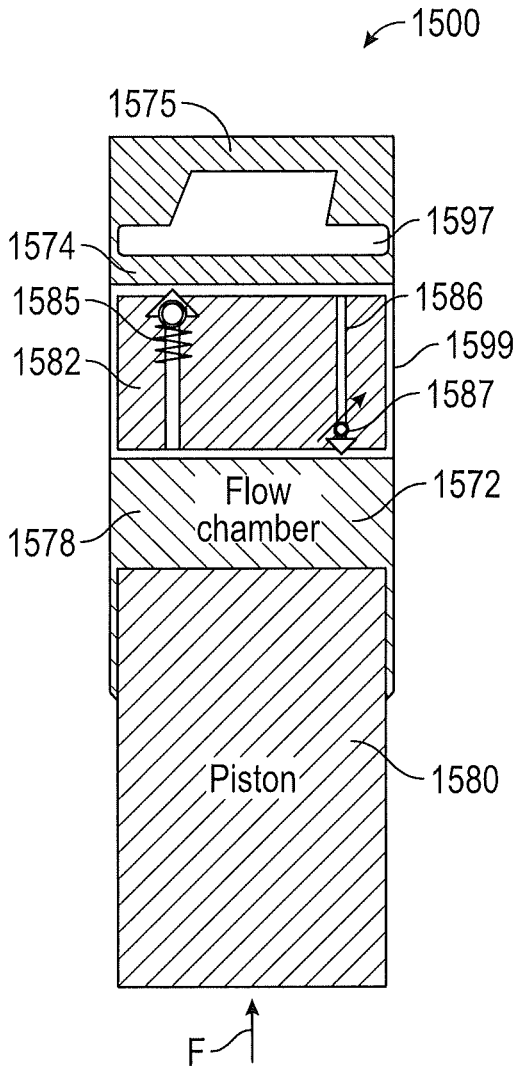
FIG. 15 shows an alternative embodiment of a rate control device.

FIG. 15 shows a rate control device 1500 that utilizes a fixed-pressure management device 1599. In an exemplary embodiment, pressure management device 1599 is stationary relative to moving piston 1580. In an exemplary embodiment, downhole fluid pressure 1575 is exerted upon separator 1597 to compensate the pressure of reservoir 1574. Fluid 1578 may flow between fluid chamber 1572 and reservoir 1574 via pressure management device 1599. In one aspect, the chamber 1572 and reservoir 1574 are in fluid communication with each other via a first fluid flow path or flow line 1582 and a second fluid flow path or flow line 1586. A flow control device, such as a check valve 1585, placed in the fluid flow line 1582, may be utilized to control the rate of flow of the fluid from reservoir 1574 to chamber 1572. Similarly, another flow control device, such as a check valve 1587, placed in fluid flow line 1586, may be utilized to control the rate of flow of the fluid 1578 from chamber 1572 to reservoir 1574. The flow control devices 1585 and 1587 may be configured at the surface to set the rates of flow through fluid flow lines 1582 and 1586, respectively. In certain embodiments, the pressure exerted from the downhole fluid pressure 1575 biases the piston 1580 downward.

Therefore in one aspect, a drill bit is disclosed, including: a bit body; a pad associated with the bit body; a rate control device coupled to the pad that extends from a bit surface at a first rate and retracts from an extended position to a retracted position at a second rate in response to external force applied onto the pad, the rate control device including: a piston for applying a force on the pad; a biasing member that applies a force on the piston to extend the pad at the first rate; a fluid chamber associated with the piston; and a pressure management device for controlling a fluid pressure within the fluid chamber. In certain embodiments, the second rate is less than the first rate. In certain embodiments, the fluid chamber is divided by the piston into a first fluid chamber and a second fluid chamber. In certain embodiments, the pressure management device is a multi-stage orifice. In certain embodiments, the pressure management device is a high-precision gap disposed between the piston and the fluid chamber. In certain embodiments, the fluid chamber is a triple-walled cylinder having a first wall, a second wall and a third wall, and at least one of the first wall, the second wall, and the third wall includes the high-precision gap. In certain embodiments, the piston is a double-acting piston, wherein a fluid acting on a first side of the piston controls at least in part the first rate and a fluid acting on a second side of the piston controls at least in part the second rate and the pressure management device includes at least one rod with both a first end and a second end both exposed to a bottomhole pressure. In certain embodiments, the rate control device includes an accumulator associated with the first side of the piston and the second side of the piston. In certain embodiments, the piston is a plurality of hydraulically linked pistons. In certain embodiments, the pad is a plurality of pads that extends from the rate control device, wherein the rate control device is centrally disposed. In certain embodiments, the rate control device is oriented with a tilt against the direction of rotation of the drill bit. In certain embodiments, the rate control device is a self-contained cartridge. In certain embodiments, the self-contained cartridge is associated with the drill bit via a press fit or a retainer.

In another aspect, a method of drilling a wellbore is disclosed, including: providing a drill bit including a bit body, a pad associated with the bit body, and a rate control device; conveying a drill string into a formation, the drill string having a drill bit at the end thereof; selectively extending the pad from a bit surface at a first rate via the rate control device; selectively retracting from an extended position to a retracted position at a second rate in response to external force applied onto the pad via the rate control device, the rate control device including: a piston for applying a force on the pad; a biasing member that applies a force on the piston to extend the pad at the first rate; a fluid chamber associated with the piston; and controlling a fluid pressure within the fluid chamber via a pressure management device; and drilling the wellbore using the drill string. In certain embodiments, the second rate is less than the first rate. In certain embodiments, the fluid chamber is divided by the piston into a first fluid chamber and a second fluid chamber. In certain embodiments, the pressure management device is a multi-stage orifice. In certain embodiments, the pressure management device is a high-precision gap disposed between the piston and the fluid chamber. In certain embodiments, the fluid chamber is a triple-walled cylinder having a first wall, a second wall and a third wall, and at least one of the first wall, the second wall, and the third wall includes the high-precision gap. In certain embodiments, the piston is a double-acting piston, wherein a fluid acting on a first side of the piston controls at least in part the first rate and a fluid acting on a second side of the piston controls at least in part the second rate and the pressure management device includes at least one rod with both a first end and a second end both exposed to a bottomhole pressure. In certain embodiments, the rate control device further includes an accumulator associated with the first side of the piston and the second side of the piston. In certain embodiments, the piston is a plurality of hydraulically linked pistons. In certain embodiments, the pad is a plurality of pads that extends from the rate control device, wherein the rate control device is centrally disposed.

In another aspect, a system for drilling a wellbore is disclosed, including: a drilling assembly having a drill bit, the drill bit including: a bit body; a pad associated with the bit body; a rate control device coupled to the pad that extends from a bit surface at a first rate and retracts from an extended position to a retracted position at a second rate in response to external force applied onto the pad, the rate control device including: a piston for applying a force on the pad; a biasing member that applies a force on the piston to extend the pad at the first rate; a fluid chamber associated with the piston; and a pressure management device for controlling a fluid pressure within the fluid chamber. In certain embodiments, the second rate is less than the first rate. In certain embodiments, the fluid chamber is divided by the piston into a first fluid chamber and a second fluid chamber. In certain embodiments, the pressure management device is a multi-stage orifice. In certain embodiments, the pressure management device is a high-precision gap disposed between the piston and the fluid chamber.

In another aspect, a drill bit is disclosed, including: a bit body; a pad associated with the bit body; a rate control device coupled to the pad that extends from a bit surface at a first rate and retracts from an extended position to a retracted position at a second rate in response to an external force applied, the rate control device including: a piston for applying a force on the pad; a biasing member that applies a force on the piston to expose the pad at the first rate; and a rotary device that applies a force on the piston to hide the pad at the second rate. In certain embodiments, the second rate is less than the first rate.

The foregoing disclosure is directed to certain specific embodiments for ease of explanation. Various changes and modifications to such embodiments, however, will be apparent to those skilled in the art. It is intended that all such changes and modifications within the scope and spirit of the appended claims be embraced by the disclosure herein.

What is claimed is:

1. A downhole rotary drilling tool, comprising:

a tool body;

a self-adjusting extendible and retractable element associated with the tool body and at least partially projecting from a surface of the tool body;

a rate control device coupled to the element, the rate control device configured to cause the element to extend outward relative to the tool body from a retracted position to an extended position at a first rate in the absence of an external force applied to the element, the rate control device configured to cause the element to retract inward relative to the tool body from the extended position to the retracted position at a second rate in response to external force applied to the element, the second rate differing from the first rate, the rate control device including:

a piston for applying a force on the element;

a biasing member that applies a force on the piston to extend the element;

a fluid chamber associated with the piston; and a pressure management device for controlling a fluid pressure within the fluid chamber.

2. The drilling tool of claim 1, wherein the second rate is less than the first rate.

3. The drilling tool of claim 1, wherein the fluid chamber is divided by the piston into a first fluid chamber and a second fluid chamber.

4. The drilling tool of claim 1, wherein the pressure management device is a multi-stage orifice.

5. The drilling tool of claim 1, wherein the pressure management device comprises a gap disposed between the piston and the fluid chamber.

6. The drilling tool of claim 5, wherein the fluid chamber comprises a triple-walled cylinder having a first wall, a second wall and a third wall, wherein at least one of the first wall, the second wall, and the third wall includes the gap.

7. The drilling tool of claim 1, wherein the piston is one piston of a plurality of hydraulically linked pistons.

8. The drilling tool of claim 1, wherein the element is a pad or a cutting element.

9. The drilling tool of claim 1, wherein the rate control device is oriented at an angle relative to a direction of intended rotation of the drilling tool so as to reduce a tangential component of a frictional force, if any, experienced by the piston.

10. The drilling tool of claim 1, wherein the rate control device is a self-contained cartridge.

11. The drilling tool of claim 10, wherein the self-contained cartridge is retained within the drilling tool via a press fit or a retainer.

12. A method of drilling a wellbore, comprising:

incorporating a drilling tool in a drill string, the drilling tool including a tool body, a self-adjusting extendible and retractable element associated with the tool body and at least partially projecting from a surface of the tool body, and a rate control device, wherein the rate control device includes a piston for applying a force on the element, a biasing member that applies a force on the piston toward the element, a fluid chamber associated with the piston, and a pressure management device for controlling a fluid pressure within the fluid chamber;

conveying the drill string into a formation;

allowing outward extension of the element relative to the tool body from a retracted position to an extended position at a first rate controlled by the rate control device in the absence of an external force applied to the element;

allowing retraction of the element from the extended position to the retracted position at a second rate controlled by the rate control device in response to external force applied to the element by the formation, the second rate differing from the first rate;

controlling the fluid pressure within the fluid chamber via a pressure management device; and drilling the wellbore using the drill string.

13. The method of claim 12, further comprising reducing vibrations in the drill string using the self-adjusting extendible and retractable element.

14. The method of claim 12, further comprising adjusting maneuverability of the drilling tool using the self-adjusting extendible and retractable element.

15. The method of claim 12, wherein the second rate is less than the first rate.

16. The method of claim 12, wherein the fluid chamber is divided by the piston into a first fluid chamber and a second fluid chamber.

17. The method of claim 12, wherein the pressure management device is a multi-stage orifice.

18. The method of claim 12, wherein the piston is one piston of a plurality of hydraulically linked pistons.

19. A downhole rotary drilling tool, comprising:

a tool body;

a contact element associated with the tool body and exterior to the tool body; and a rate control device disposed within the tool body, the rate control device configured to cause the contact element to move from a first orientation to a second orientation in the absence of an external force applied to the element, the rate control device comprising:

a shaft attached to the contact element and extending from the contact element and into to the tool body;

a rotary seal at a mud-oil interface of the tool body of the drilling tool, the shaft extending through the rotary seal;

a first cam member coupled to the shaft within the tool body;

a piston for rotating the first cam member;

a follower member attached to the piston and in contact with the first cam member;

a biasing member that applies a force on the piston to rotate the first cam member;

a fluid chamber associated with the piston; and a second cam member configured to rotate the shaft and the first cam member upon experiencing an external load on the second cam member.

20. A method of forming a downhole rotary drilling tool, the method comprising:

forming a tool body;

coupling a self-adjusting extendible and retractable element to a rate control device configured to cause the element to extend outward relative to the tool body from a retracted position to an extended position at a first rate in the absence of an external force applied to the element, the rate control device configured to cause the element to retract inward relative to the tool body from the extended position to the retracted position at a second rate in response to external force applied to the element, the second rate differing from the first rate, the rate control device comprising:

a piston for applying a force on the element;

a biasing member that applies a force on the piston to extend the element;

a fluid chamber associated with the piston; and a pressure management device for controlling a fluid pressure within the fluid chamber; and disposing the rate control device within the tool body such that the element at least partially projects from a surface of the tool body.

21. The method of claim 20, wherein the second rate is less than the first rate.

22. The method of claim 20, wherein the fluid chamber is divided by the piston into a first fluid chamber and a second fluid chamber.

23. The method of claim 20, wherein the piston is one piston of a plurality of hydraulically linked pistons.

24. The method of claim 20, wherein the rate control device is a self-contained cartridge.

25. The method of claim 20, wherein the self-contained cartridge is retained within the drilling tool via a press fit or a retainer.

26. The method of claim 20, wherein disposing the rate control device within the tool body comprises orienting the rate control device at an angle relative to a direction of intended rotation of the drilling tool so as to reduce a tangential component of a frictional force, if any, experienced by the piston.

* * * * *